US007198707B2

(12) United States Patent
Chang et al.

(10) Patent No.: US 7,198,707 B2
(45) Date of Patent: Apr. 3, 2007

(54) APPARATUS FOR CATHODIC PROTECTION IN AN ENVIRONMENT IN WHICH THIN FILM CORROSIVE FLUIDS ARE FORMED AND METHOD THEREOF

(75) Inventors: Hyun Young Chang, Kwangju (KR); Gon Hwangbo, Seongnam (KR); Tae Eun Jin, Seongnam (KR); Min Yu Shin, Seoul (KR)

(73) Assignee: Korea Power Engineering Co. Inc., Kyungki-do (KR)

( * ) Notice: Subject to any disclaimer, the term of this patent is extended or adjusted under 35 U.S.C. 154(b) by 156 days.

(21) Appl. No.: 10/537,988

(22) PCT Filed: Feb. 12, 2003

(86) PCT No.: PCT/KR03/00299

§ 371 (c)(1),
(2), (4) Date: Jun. 9, 2005

(87) PCT Pub. No.: WO2004/055239

PCT Pub. Date: Jul. 1, 2004

(65) Prior Publication Data

US 2006/0163084 A1 Jul. 27, 2006

(30) Foreign Application Priority Data

Dec. 13, 2002 (KR) ..... 10-2002-0079430
Dec. 13, 2002 (KR) ..... 10-2002-0079431

(51) Int. Cl.
*C23F 13/20* (2006.01)

(52) U.S. Cl. ..... 205/740; 204/196.12; 204/196.15; 204/196.16; 204/196.18; 204/196.19; 205/724

(58) Field of Classification Search ..... 204/196.12, 204/196.15, 196.16, 196.18, 196.19; 205/724, 205/740
See application file for complete search history.

(56) References Cited

FOREIGN PATENT DOCUMENTS

| | | | |
|---|---|---|---|
| JP | 63-006717 | | 1/1988 |
| JP | 63-6717 | A | 1/1988 |
| JP | 63-210501 | A | 9/1988 |
| JP | P1998-0210501 | | 9/1988 |
| KR | 89-12148 | A | 8/1989 |
| KR | P1989-0012148 | | 8/1989 |
| KR | 92-2632 | A | 2/1992 |
| KR | U1992-0004907 | | 7/1992 |

*Primary Examiner*—Bruce F. Bell
(74) *Attorney, Agent, or Firm*—Nixon & Vanderhye PC

(57) ABSTRACT

An apparatus and method for cathodic protection in an environment where thin film corrosive fluids are formed is provided. The apparatus which protects from corrosion an object exposed to the thin film corrosive fluids, by artificially adjusting a potential of the object, comprises a DC power supply of which cathode is electrically connected to the object to be corrosion-protected, and an anodic assembly of which anode is electrically connected to the DC power supply. The anodic assembly includes an insulating filter member through which the corrosive fluids pass and which forms an accommodation space inside the insulating filter member, an anodic member accommodated in the insulating filter member, an electrode lead line which electrically connects the DC power supply to the anodic member, and an absorption conductive member which is accommodated in the insulating filter member to surround the circumference of the anodic member and absorbs the corrosive fluids flowing along an exposed surface of the object to be corrosion-protected.

13 Claims, 4 Drawing Sheets

APPARATUS FOR CATHODIC PROTECTION IN AN ENVIRONMENT IN WHICH THIN FILM CORROSIVE FLUIDS ARE FORMED AND METHOD THEREOF

This application is the U.S. national phase of international application PCT/KR2003/000299, filed 12 Feb. 2003, which designated the U.S. and claims priority of KR 2002/0079430, filed 13 Dec. 2002, and KR 2002/0079431, filed 13 Dec. 2003, the entire contents of each of which are hereby incorporated by reference.

TECHNICAL FIELD

The present invention relates to an apparatus and method for cathodic protection in an environment where thin film corrosive fluids are formed, and more particularly, to an apparatus and method which also can corrosion-protect an object exposed to hot and humid gas-family corrosive fluids.

BACKGROUND ART

Almost all metallic materials used in industries are extracted from raw ores and restored into their original metallic states in time. Thus, as time passes, metallic materials used to construct industrial structures or buildings react with an environment and are inevitably corroded or oxidized. This corrosion is mainly generated by electrochemical reactions caused by the movement of electrons, and thus it is called electrochemical corrosion. Metallic structures are in corrosive battery states while corrosion is progressing such that a corrosive potential is generated and a predetermined corrosive current flows through the metallic structures.

In general, corrosion protection is to eliminate or suppress one or more conditions from main causes of corrosion. Electric protection is a method for suppressing corrosion of facilities or structures mainly by artificially adjusting a potential or current of facilities or structures requiring such protection. Electric protection includes anodic protection of anodizing an object to be corrosion-protected and cathodic protection of cathodizing the object to be corrosion-protected. In the case of anodic protection, when potential adjustment is not precisely performed, corrosion may be accelerated. Thus, anodic protection is used under certain conditions, and cathodic protection is usually used.

Cathodic protection is a method for preventing corrosion by artificially reducing the potential of an object to be corrosion-protected. The cathodic protection is divided into a sacrificial anodic method and an external power method by the manner of applying an anticorrosive current. In the sacrificial anodic method, metals that can be easily ionized are electrically connected in an electrolyte to act as an anode, thereby cathodizing the object to be corrosion-protected. In the external power method, a cathode (−) of a DC power supply or a rectifier is connected to the object to be corrosion-protected, and an anode (+) of the DC power supply or the rectifier is connected to a cathode member, thereby obtaining an anticorrosive current.

Meanwhile, exhaust gases generated from combustion facilities such as a steam power plant and an incinerator, or sulfuric compounds contained in a hot and humid gas generated in a general chemical plant are changed into a sulfurous acid gas by the following reaction.

$$SO_2+O_2 \rightarrow SO_3+O$$

The sulfurous acid gas reacts with water below a dew point and is balanced as $H_2—SO_3—H_2SO_4$. In addition, the sulfurous acid gas is condensed on a metallic surface below a dew point comparatively lower than that of a flowing gas generated in bottoms, walls, or ceilings of exhaust gas-family facilities and exists in the form of a thick film and thin film high-concentration sulfuric solution. The sulfuric solution causes serious corrosion of materials such as high alloy steel and coating, on the basis of the period of starting and suspension of facilities. In addition, the sulfuric solution causes a harmful gas to leak out of corroded and damaged facilities and serious environmental problems. Thus, desulfurization facilities are made of high-priced special anticorrosive alloy in consideration of corrosion. However, the desulfurization facilities are easily corroded in a hot and humid environment which is a characteristic of condensed sulfuric acid and exhaust gas facilities. Due to frequent stoppage of facilities for maintenance, an economical efficiency in operation of facilities is lowered, and for maintenance, high-priced special anticorrosive alloy or lining materials should be repeatedly used, yielding many additional costs. Thus, if the aforementioned electric protection is performed in desulfurization facilities, corrosion of desulfurization facilities can be prevented. As a result, maintenance costs can be reduced, and inferior materials instead of high-priced special anticorrosive steel, can be used in desulfurization facilities. Thus, construction costs can also be reduced.

However, a conventional apparatus and method for electric protection can be used in various fields such as buried piping, ocean facilities, shipping, and cooling systems in a power plant. However, the conventional apparatus and method for electric protection can be used only in an environment where a sacrificial anodic member or an insoluble anodic member is completely dipped in corrosive fluids. Thus, the conventional apparatus and method for electric protection cannot be used in an environment where thin film corrosive fluids are formed, like in a duct of desulfurization facilities. In addition, in the conventional apparatus and method for electric protection, due to high electric conductivity like the case where corrosive fluids are a sulfuric solution which is a waste solution flowing through a duct of desulfurization facilities, if electric protection is performed, the amount of consumption of an anticorrosive current increases. In addition, when an object to be corrosion-protected is used in an environment that severely varies in time and in addition the position of the object in the environment is not constant, it is not easy to determine an anticorrosive current or a potential. As such, it is difficult to use the conventional apparatus and method for the electric protection of metallic structures such as a duct of desulfurization facilities.

DISCLOSURE OF THE INVENTION

The present invention provides an apparatus and method for cathodic protection in an environment where thin film corrosive fluids are formed, which can supply a sufficient current required for electric protection even when an object to be corrosion-protected continuously contacts corrosive fluids having strong corrosiveness and is not completely dipped in the corrosive fluids, like in a duct of desulfurization facilities, such that the life span of the object to be corrosion-protected is remarkably lengthened.

The present invention also provides a method for cathodic protection in an environment where thin film corrosive fluids are formed, which can perform electric protection economically and effectively even when due to high electric conductivity, like in the case where corrosive fluids contacting an object to be corrosion-protected are a sulfuric solution which is a waste solution flowing through a duct of desulfurization facilities, if a conventional electric protection method is performed, the amount of consumption of an anticorrosive current increases, and the object to be corrosion-protected is used in an environment that severely varies in time and in addition the position of the object in the environment is not constant.

According to one aspect of the present invention, there is provided an apparatus for cathodic protection in an environment where thin film corrosive fluids are formed, which protects from corrosion an object exposed to the thin film corrosive fluids, by artificially adjusting a potential of the object, the apparatus comprising a DC power supply of which cathode is electrically connected to the object to be corrosion-protected, and an anodic assembly of which anode is electrically connected to the DC power supply. The anodic assembly includes an insulating filter member through which the corrosive fluids pass and which forms an accommodation space inside the insulating filter member, an anodic member accommodated in the insulating filter member, an electrode lead line which electrically connects the DC power supply to the anodic member, and an absorption conductive member which is accommodated in the insulating filter member to surround the circumference of the anodic member and absorbs the corrosive fluids flowing along an exposed surface of the object to be corrosion-protected.

It is preferable that the anodic member includes a tubular anodic member arranged in parallel to the exposed surface of the object to be corrosion-protected, and a plate-type anodic member combined with the outer circumference of the tubular anodic member. As such, the anodic member has a sufficient large area to be in contact with the corrosive fluids.

Meanwhile, it is also preferable in installation rather than welding that the anodic assembly further includes an engagement combination portion which holds an end of the electrode lead line and is engaged with an inner circumference of the tubular anodic member so that the end of the electrode lead line contacts the inner circumference of the tubular anodic member.

Here, it is also preferable that the engagement combination portion comprises a holder member which supports the end of the electrode lead line and has a large diameter part inserted into an inside of the tubular anodic member so that the end of the electrode lead line contacts the inner circumference of the tubular anodic member, and a small diameter part which has an outer diameter smaller than that of the large diameter part and in which a screw hole is formed, a diameter-enlarging member which is arranged to move forward and backward to the large diameter part of the holder member on the outer circumference of the small diameter part of the holder member and has a plurality of elastic pieces arranged to be spaced apart from one another in a circumference direction on one of its ends, and a screw member which is combined with a screw hole of the small diameter member of the holder member wherein the diameter-enlarging member is placed between the screw member and the holder member, enlarges the diameter of the elastic pieces of the diameter-enlarging member by pressing the diameter-enlarging member toward the large diameter part and moving forward when rotating in an engagement direction of the screw hole, and is maintained to contact the inner circumference of the tubular anodic member.

The anodic assembly further includes an insulating thin plate interposed between the surface of the object to be corrosion-protected and the insulating filter member and in a partial region where a perforated contact hole is formed, thereby remarkably preventing from the anodic member from contacting an exposed surface of the object to be corrosion-protected when the anodic member is broken.

The anodic assembly further comprises a support which is combined with the exposed surface so that the support is stood and arranged on the exposed surface of the object to be corrosion-protected and which supports the anodic member to be spaced apart from the exposed surface, and an insulating connection member wherein a through hole through which the electrode lead line is passed is formed in a central region of the insulating connection member in a lengthwise direction, and both ends of which are detachably combined with ends of the support and the anodic member.

Preferably, the insulating filter member is a non-woven fabric lining, and the absorption conductive member is coke breeze.

According to another aspect of the present invention, there is provided a method for cathodic protection in an environment where thin film corrosive fluids are formed, which protects from corrosion an object exposed to the thin film corrosive fluids, by artificially adjusting a potential of the object, the method comprising providing an anodic assembly having an anodic member that is electrically connected to a DC power supply, installing the anodic assembly on an exposed surface of the object to be corrosion-protected so that the anodic member is spaced apart from the exposed surface of the object to be corrosion-protected, and electrically connecting a cathode of the DC power supply to the object to be corrosion-protected, forming a resin coating layer on the exposed surface by coating acid resisting and thermostable resin coating material, and flowing a current between the anodic member and the cathode.

Here, a painting layer is further formed between the exposed surface of the object to be corrosion-objected and the resin coating layer.

In addition, the anodic assembly further includes an insulating filter member through which the corrosive fluids pass and which accommodates the anodic member in an accommodation space formed inside the insulating filter member, an electrode lead line which electrically connects the DC power supply to the anodic member, and an absorption conductive member which is accommodated in the insulating filter member to surround the circumference of the anodic member and absorbs the corrosive fluids flowing along an exposed surface of the object to be corrosion-protected, and further comprising absorbing the corrosive fluids flowing around the exposed surface of the object to be corrosion-protected into the absorption conductive member. As such, a sufficient current required for electric protection can be supplied even when the object to be corrosion-protected continuously contacts corrosive fluids having strong corrosiveness and is not completely dipped in the corrosive fluids.

Meanwhile, the object to be corrosion-protected is a duct of desulfurization facilities, and the corrosive fluids are a sulfuric acid solution.

In addition, the resin coating material used for the resin coating layer is fluoric elastoma.

BRIEF DESCRIPTION OF THE DRAWINGS

The above and other aspects and advantages of the present invention will become more apparent by describing in detail preferred embodiments thereof with reference to the attached drawings in which.

BEST MODE FOR CARRYING OUT THE INVENTION

Hereinafter, the present invention will be described in detail by describing preferred embodiments of the invention with reference to the accompanying drawings.

Figure 1:
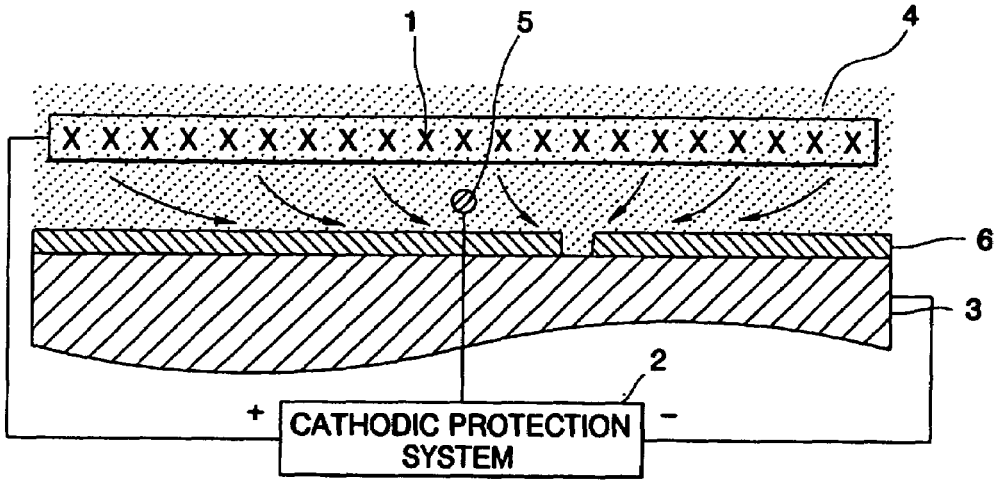
FIG. 1 is a diagram schematically illustrating an apparatus for cathodic protection in an environment where thin film corrosive fluids are formed, according to the present invention.

FIG. 1 is a diagram schematically illustrating an apparatus for cathodic protection in an environment where thin film corrosive fluids are formed, according to the present invention. As shown in FIG. 1, a cathodic protection system 2 includes a DC power supply (not shown) of which anode (+) is connected to an anodic assembly 1 and cathode (−) is connected to an object 3 to be corrosion-protected, and a potential measuring unit (not shown) that is electrically connected to a reference electrode 5 and the object 3 to be corrosion-protected. The cathodic protection system 2 measures the potential of the object 3 to be corrosion-protected with respect to the reference electrode 5 using the potential measuring unit, sets an output of the DC power supply based on the measured potential, makes a predetermined anticorrosive current from the DC power supply to flow through the object 3 to be corrosion-protected via corrosive fluids 4 from an anodic member 22, which will be described later, of the cathodic assembly 1, thereby performing corrosion protection of the object 3 to be corrosion-protected. Here, a resin coating layer 6 coated with fluoric elastoma or a ceramic-reinforced coating material is formed on an exposed surface of the object 3 to be corrosion-protected, exposed to the corrosive fluids 4. The resin coating layer 6 basically protects the object 3 to be corrosion-protected. When the resin coating layer 6 is damaged by natural or mechanical deterioration, a damaged portion of the resin coating layer 6 is intensively protected by an anticorrosive current, such that a small amount of current is consumed, the range of the anticorrosive current becomes still larger, and the object 3 to be corrosion-protected can be effectively corrosion-protected. Thus, even when corrosive fluids are desulfurization facility condensed water, that is, when pH value is very low, the concentration of sulfuric acid is high and electric conductivity is very high, electric protection can be effectively performed.

For convenience of explanation, in FIG. 1, the anodic assembly 1 is not completely dipped in the corrosive fluids 4 but absorbs the corrosive fluids 4 by continuous contact of the corrosive fluids 4 flowing along the exposed surface of the object 3 to be corrosion-protected, and a sufficient amount of the corrosive fluids 4 exists in the anodic assembly 1 and the object 3 to be corrosion-protected.

Figure 2:
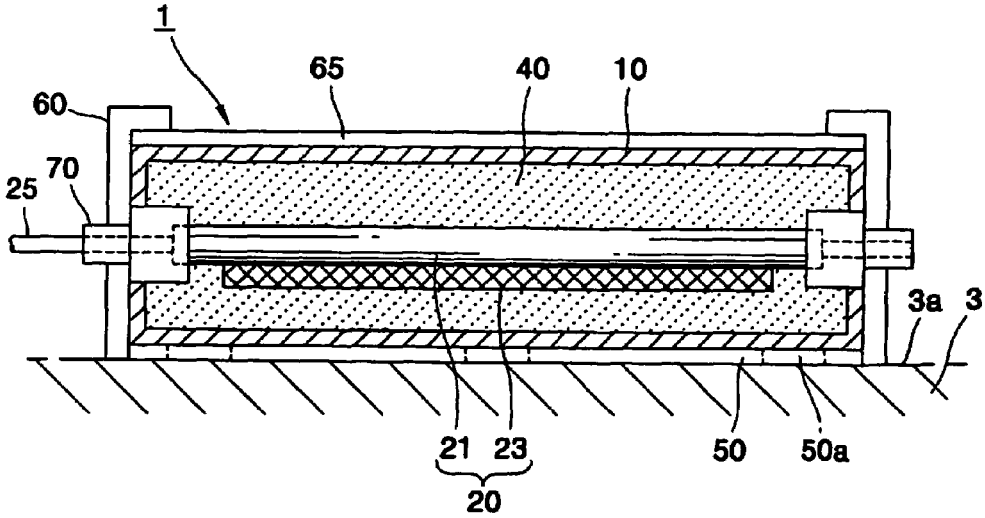
FIG. 2 is a cross-sectional view of an anodic assembly of FIG. 1.

FIG. 2 is a cross-sectional view of an anodic assembly of FIG. 1. As shown in FIG. 2, the anodic assembly 1 includes an insulating filter member 10 through which corrosive fluids pass and which forms an accommodation space inside the insulating filter member 10, an anodic member 20 accommodated in the insulating filter member 10, an electrode lead line 25 which electrically connects a DC power supply (not shown) to the anodic member 20, an absorption conductive member 40 which is accommodated in the insulating filter member 10 to surround the circumference of the anodic member 20 and absorbs the corrosive fluids flowing along the exposed surface 3*a* of the object 3 to be corrosion-protected, an insulating thin plate 50 which is interposed between the surface of the object 3 to be corrosion-protected and the insulating filter member 10, a support 60 which is combined with the exposed surface 3*a* so that the support 60 is stood and arranged on the exposed surface 3*a* of the object 3 to be corrosion-protected and which supports the anodic member 20 to be spaced apart from the exposed surface 3*a*, and an insulating connection member 70 which is detachably combined with ends of the support 60 and the anodic member 20.

The insulating filter member 10 forms an accommodation space inside the insulating filter member 10 and is a non-woven fabric lining. When the corrosive fluids flow through the insulating filter member 10, the corrosive fluids pass through the insulating filter member 10 and are absorbed into the absorption conductive member 40. As such, the insulating filter member 10 performs an insulation function.

Figure 3:
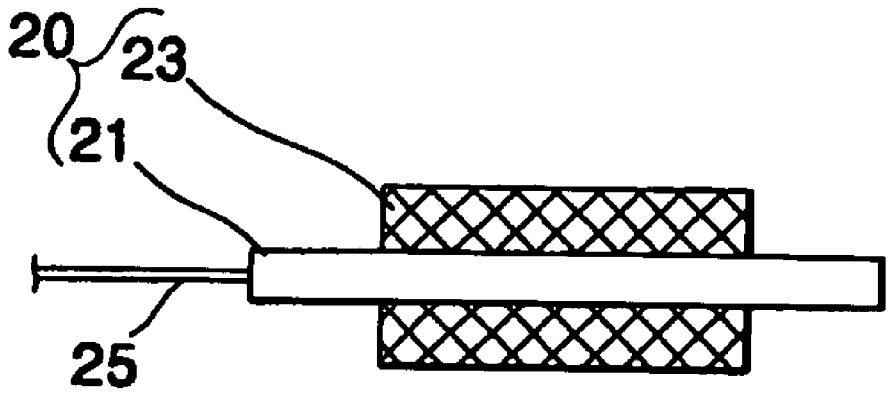
FIG. 3 is a plan view of an anodic member of FIG. 2 for explaining the state where a tubular anodic member and a plate-type anodic member are combined with each other.

FIG. 3 is a plan view of an anodic member of FIG. 2 for explaining the state where a tubular anodic member and a plate-type anodic member are combined with each other. Referring to FIG. 3 with FIG. 2, the anodic member 20, made of titanium and coated with a precious metallic oxide, includes a tubular anodic member 21 having a tubular shape arranged parallel to the exposed surface 3*a* of the object 3 to be corrosion-protected, and a plate-type anodic member 23 having a plate shape combined with the outer circumference of the tubular anodic member 21. The tubular anodic member 21 is combined with the electrode lead line 25 and the engagement combination portion 30 such that the electrode lead line 25 is not exposed and is connected to the anodic member 20. As the plate-type anodic member 23 has a sufficient large area to be in contact with the corrosive fluids, the most amount of an anticorrosive current supplied to the plate-type anodic member 23 is supplied to the object 3 to be corrosion-protected via the corrosive fluids. Meanwhile, the length of the tubular anodic member 21 is larger than that of the plate-type anodic member 23.

The electrode lead line 25 is connected to a DC power supply (not shown) and electrically connects the anodic member 20 to the DC power supply. The electrode lead line 25 is connected to the tubular anodic member 21 by the engagement combination portion 30.

Figure 4:
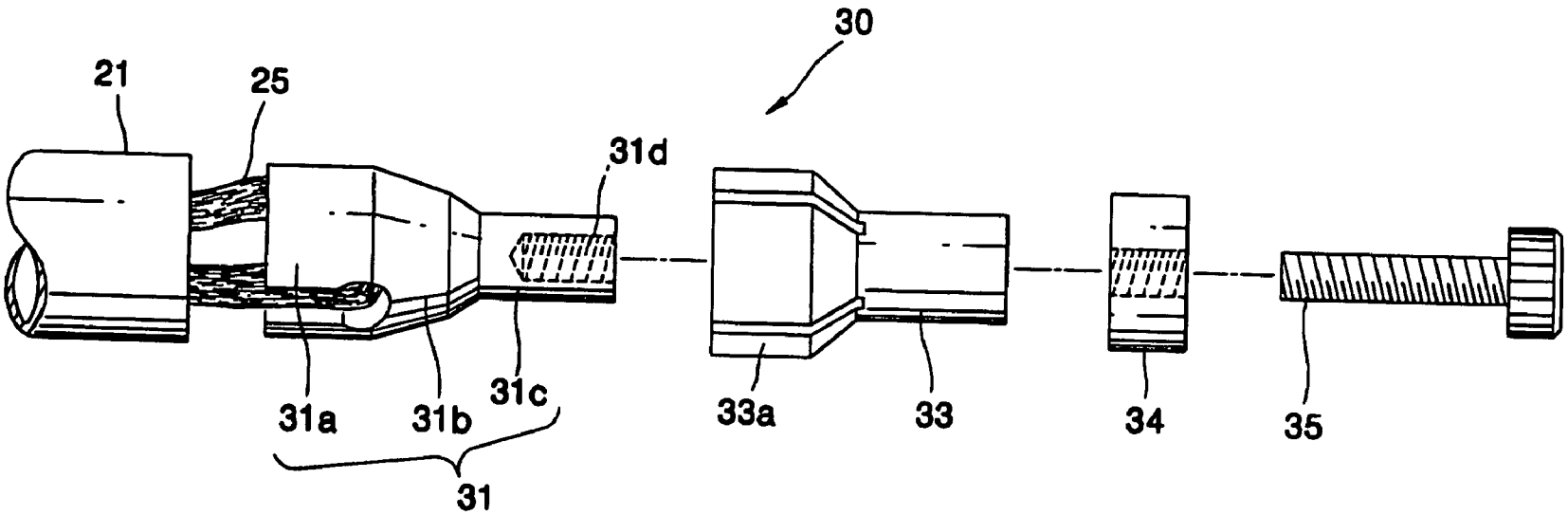
FIG. 4 illustrates the state of FIG. 2 where the anodic member is combined with an engagement combination portion for connecting an electrode lead line.

FIG. 4 illustrates the state of FIG. 2 where the anodic member is combined with an engagement combination portion for connecting an electrode lead line. As shown in FIG. 4, the engagement combination portion 30 includes a holder member 31 which holds an end of the electrode lead line 25, a diameter-enlarging member 33 having a plurality of elastic pieces 33*a* arranged to be spaced apart from one another in a circumference direction on one of its ends, a screw member 35 combined with the holder member 31 wherein the diameter-enlarging member 33 is placed between the screw member 35 and the holder member 31, and a washer member 34 arranged between the screw member 35 and the diameter-enlarging member 33.

The holder member 31 includes a large diameter part 31*a* which supports an end of the electrode lead line 25, a small diameter part 31*c* which has an outer diameter smaller than that of the large diameter part 31*a* and in which a screw hole 31*d* is formed, and a slant part 31*b* which connects the large diameter part 31*a* to the small diameter part 31*c*. The diameter-enlarging member 33 is arranged to move forward and backward to the large diameter part 31*a* of the holder member 31 on the outer circumference of the small diameter part 31*c* of the holder member 31. When the diameter-enlarging member 33 moves forward to the large diameter part 31*a* of the holder member 31, an end placed at the elastic pieces 33*a* is moved to the slant part 31*b*, and thus, the diameter of the elastic pieces 33*a* is enlarged. When the diameter of the elastic pieces 33*a* of the diameter-enlarging member 33 is enlarged, the elastic pieces 33*a* closely adhere to the inner circumference of the tubular anodic member 21 and is maintained to contact the tubular anodic member 21. A forward-movement of the diameter enlarging member 33 to the holder member 31 is performed when the screw member 35 is engaged with the screw hole 31*d* of the holder member 31 wherein the diameter-enlarging member 33 is placed between the holder member 31 and the screw member 35. The washer member 34 is provided between the screw member 35 and the diameter-enlarging member 33. When the diameter-enlarging member 33 contacts the inner circumference of the tubular anodic member 21, the electrode lead line 25 that perforates the holder member 31 is maintained to contact the inner circumference of the tubular anodic member 21. As such, the electrode lead line 25 can be conveniently connected to the anodic member 20 without welding. When a plurality of the anodic assemblies 1 are installed, a part of the electrode lead line 25 contacts the tubular anodic member 21, and the other part of the electrode lead line 25 extends, is pulled out toward the screw member 35, and connected to a tubular anodic member of another anodic assembly. For this purpose, the shape of the diameter-enlarging member 33 and the screw member 35 should be slightly modified. After the electrode lead line 25 is connected to the anodic member 20 with the engagement combination portion 30, an inside of the tubular anodic member 21 is completely sealed with an acid resisting and thermostable sealing member (not shown).

The absorption conductive member 40, accommodated in the insulating filter member 10 to surround the anodic member 20, is coke breeze. The coke breeze can absorb corrosive fluids and is a conductive material.

The insulating thin plate 50 prevents the anodic member 20 from direct contacting the exposed surface 3*a* of the object 3 to be corrosion-protected when the anodic member 20 is broken. The insulating thin plate 50 is made of Teflon. A perforated contact hole 50*a* is formed in a partial region of the insulating thin plate 50 so that the corrosive materials absorbed into the absorption conductive member 40 contacts the exposed surface 3*a* of the object 3 to be corrosion-protected. Meanwhile, a cover 65 is installed on top of the insulating filter member 10.

The support 60 is welded on the exposed surface 3*a* of the object 3 to be corrosion-protected, using the same material as metallic material used for the object 3 to be corrosion-protected.

Figure 5:
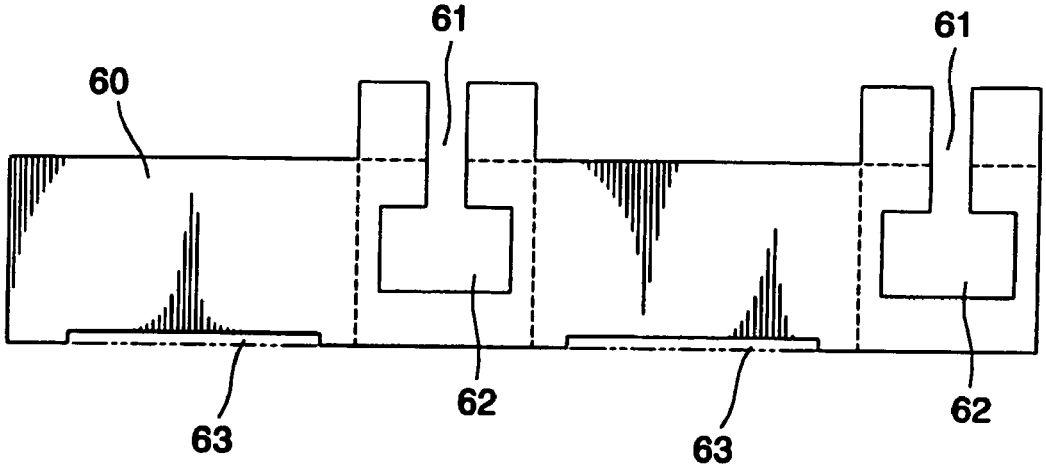
FIG. 5 is a cross-sectional view of a support of FIG. 2.

FIG. 5 is a cross-sectional view of a support of FIG. 2. As shown in FIG. 5, the support 60 includes an installation hole 62 where an end of the insulating connection member 70 is installed, and an insertion hole 61 via which the end of the insulating connection member 70 is installed in the installation hole 62. A passage stub part 63 is formed on a lower end of the support 60 so that the corrosive fluids are not intercepted by the support 60 and pass through the support 60. However, when the support 60 is installed on a sidewall of an exhaust gas duct, the lower part of the support 60 is completely intercepted so that the corrosive fluids do not flow down and leak out. Thus, the corrosive fluids flowing along the wall of the exhaust gas duct stay in the support 60 such that the anodic member 20 sufficiently contacts the corrosive fluids and current can be smoothly supplied.

Figure 6:
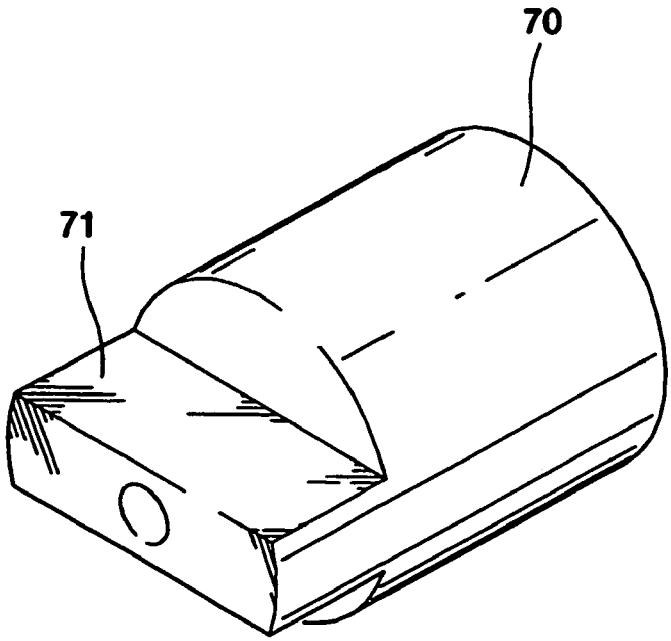
FIG. 6 is a perspective view of an insulating connection member of FIG. 2.

FIG. 6 is a perspective view of an insulating connection member of FIG. 2. As shown in FIG. 6, a protrusion 71 is provided at one side of the insulating connection member 70. An end of the tubular anodic member 21 is inserted in an opposite side to the protrusion 71 of the insulating connection member 70, and the protrusion 71 is engaged and installed in the installation hole 62 of the support 60. Since the insulating connection member 70 is made of Teflon, the anodic member 20 is maintained in an insulated state with the support 60 made of the same material as that of the object 3 to be corrosion-protected and supported. The insulating connection member 70 may be made of plastics.

According to the above structure, a method for cathodic protection in an environment where thin film corrosive fluids are formed, according to the present invention will be described below.

First, an anodic assembly 1 having an anodic member 20 electrically connected to a DC power supply is provided. The anodic assembly 1 may use only the anodic member 20 only if the anodic member 20 is sufficiently buried in the corrosive fluids. However, in an environment where thin film corrosive fluids 4 are formed, the anodic assembly 1 should include an absorption conductive member 20 so that the corrosive fluids 4 flowing around the surface of the object 3 to be corrosion-protected is absorbed into the absorption conductive member 40 and a sufficient amount of the corrosive fluids 4 exists between the anodic member 20 and the object 3 to be corrosion-protected.

Next, the anodic assembly 1 is installed on an exposed surface of the object to be corrosion-protected, exposed to the corrosive fluids 4 so that the anodic member 20 is spaced apart from the exposed surface of the object 3 to be corrosion-protected, and a cathode (−) of the DC power supply is electrically connected to the object 3 to be corrosion-protected. The number and arrangement of the anodic assembly 1 should be determined depending on the results of on-the-spot survey and reproduction experiment. Depending on spot conditions, the anodic assembly 1 may be installed by connecting a single electrode lead line 25 or three or five electrode lead lines 25 to one another. When the object 3 to be corrosion-protected is a duct, the anodic assembly 1 is installed inside the duct, and thus, a cathode of the DC power supply is connected in a proper position outside the duct. In this case, the electrode lead line 25 and the object 3 to be corrosion-protected are connected by welding, and welded portions of the electrode lead line 25 and the object 3 to be corrosion-protected are insulated.

Subsequently, a resin coating layer 6 is formed on the exposed surface of the object 3 to be corrosion-protected by coating acid resisting and thermostable resin coating material, e.g., fluoric elastoma or ceramic-reinforced coating material in the present embodiment. In this way, the fluoric resin is used in an environment where corrosion is very serious, like in a duct of desulfurization facilities. The fluoric resin is a synthetic high molecular resin containing fluorine (F) in molecules and has an excellent thermostable property, a medicine resisting property, an abrasion resisting property, an electric insulating property, a high frequency property, an inadhesive low frictional coefficient, and a wet property. Preferably, the ceramic-reinforced coating material is a particle-reinforced composite coating material which enables to have a resisting property to corrosion, erosion, and medicines by mixing ceramic particles with acid resisting resin by maximum 90%.

Next, the corrosive fluids flowing around the exposed surface of the object 3 to be corrosion-protected are absorbed into the absorption conductive member 40 of the anodic assembly 1. When the anodic member 20 is dipped in the corrosive fluids, electric protection cannot be directly performed. However, when a thin film high-concentration sulfuric acid solution is condensed on the surface of the object 3 to be corrosion-protected and remains thereon, like in the duct of desulfurization facilities, electric protection can be performed after the sulfuric acid solution is absorbed into the absorption conductive member 40 of the anodic assembly 1 and stays around the anodic member 20. In this case, the corrosive fluids absorbed into the absorption conductive member 40 stay in a contact hole 25*a* of the insulating thin plate 50 such that the anodic member 23 and the object 3 to be corrosion-protected are in contact with the corrosive fluids.

Last, an anticorrosive current flows between the anodic member 20 and a cathode, thereby corrosion-protecting the object 3 to be corrosion-protected. However, the resin coating layer 6 basically protects the object 3 to be corrosion-protected. Thus, when the resin coating layer 6 is formed on the entire exposed surface of the object 3 to be corrosion-protected, the anticorrosive current does not flow between the anodic member 20 and a cathode. However, when the resin coating layer 6 is damaged by natural or mechanical deterioration, the anticorrosive current flows between the anodic member 20 and a cathode, and a damaged portion of the resin coating layer 6 is intensively protected, thereby corrosion-protecting the object 3 to be corrosion-protected. In this case, damage of the resin coating layer 6 may be detected by a potential measuring unit (not shown) that is electrically connected to a reference electrode 5 and the object 3 to be corrosion-protected.

As described above, the anodic assembly 1 includes the absorption conductive member 40 that can absorb the corrosive fluids flowing through the exposed surface of the object 3 to be corrosion-protected, such that a sufficient current required for electric protection can be supplied even when the object 3 to be corrosion-protected continuously contacts corrosive fluids having strong corrosiveness and is not completely dipped in the corrosive fluids, like in a duct of desulfurization facilities and the life span of the object 3 to be corrosion-protected can be remarkably lengthened.

In the above-described embodiment, the support 60 is welded on the exposed surface 3*a* of the object 3 to be corrosion-protected, using the same material as that of the object 3 to be corrosion-protected. However, the support 60 may be made of an insulating material and may contact the exposed surface 3*a*. In this case, the insulating filter member 10 can be fixed by the support 60 without configuring the insulating connection member 70.

In addition, in the above-described embodiment, the anodic assembly 1 includes the support 60, the insulating thin plate 50, and the cover 65. However, this configuration is for stability and maintenance. Thus, even though the anodic assembly 1 does not include them, the effect of the present invention can be achieved.

In addition, in the above-described embodiment, the resin coating layer 6 is formed after the anodic assembly 1 is installed and the cathode of the DC power supply is connected to the object 3 to be corrosion-protected. However, the order of the above two steps may be changed. If the anodic member 20 is completely dipped in the corrosive fluids, the anodic assembly 1 may be composed of the anodic member 20. In this case, the step of absorbing the corrosive fluids into the absorption conductive member 40 of the anodic assembly 1 may not be needed.

In addition, in the above-described embodiment, a painting layer is not formed in the duct of desulfurization facilities which is the object 3 to be corrosion-protected. However, even though the coating layer is formed in the duct of desulfurization facilities, the resin coating layer 6 is formed on the painting layer, and electric protection can be performed.

INDUSTRIAL APPLICABILITY

As described above, in an apparatus and method for cathodic protection in an environment where thin film corrosive fluids are formed according to the present invention, a sufficient current required for electric protection can be supplied even when an object to be corrosion-protected continuously contacts corrosive fluids having strong corrosiveness and is not completely dipped in the corrosive fluids, like in a duct of desulfurization facilities, such that the life span of the object to be corrosion-protected is remarkably lengthened.

In addition, in a method for cathodic protection in an environment where thin film corrosive fluids are formed according to the present invention, electric protection can be economically and effectively performed even when due to high electric conductivity, like in the case where corrosive fluids contacting an object to be corrosion-protected are a sulfuric solution which is a waste solution flowing through a duct of desulfurization facilities, if a conventional electric protection method is performed, the amount of consumption of an anticorrosive current increases, and the object to be corrosion-protected is used in an environment that severely varies in time and in addition the position of the object in the environment is not constant.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus for cathodic protection in an environment where thin film corrosive fluids are formed, which protects from corrosion an object exposed to the thin film corrosive fluids, by artificially adjusting a potential of the object, the apparatus comprising:

a DC power supply of which cathode is electrically connected to the object to be corrosion-protected; and an anodic assembly of which anode is electrically connected to the DC power supply;

wherein the anodic assembly includes an insulating filter member through which the corrosive fluids pass and which forms an accommodation space inside the insulating filter member, an anodic member accommodated in the insulating filter member, an electrode lead line which electrically connects the DC power supply to the anodic member, and an absorption conductive member which is accommodated in the insulating filter member to surround the circumference of the anodic member and absorbs the corrosive fluids flowing along an exposed surface of the object to be corrosion-protected.

2. The apparatus of claim 1, wherein the anodic member includes a tubular anodic member arranged in parallel to the exposed surface of the object to be corrosion-protected.

3. The apparatus of claim 2, wherein the anodic member further includes a plate-type anodic member combined with the outer circumference of the tubular anodic member.

4. The apparatus of claim 2, wherein the anodic assembly further includes an engagement combination portion which holds an end of the electrode lead line and is engaged with an inner circumference of the tubular anodic member so that the end of the electrode lead line contacts the inner circumference of the tubular anodic member.

5. The apparatus of claim 4, wherein the engagement combination portion comprises:

a holder member which supports the end of the electrode lead line and has a large diameter part inserted into an inside of the tubular anodic member so that the end of the electrode lead line contacts the inner circumference of the tubular anodic member, and a small diameter part which has an outer diameter smaller than that of the large diameter part and in which a screw hole is formed;

a diameter-enlarging member which is arranged to move forward and backward to the large diameter part of the holder member on the outer circumference of the small diameter part of the holder member and has a plurality of elastic pieces arranged to be spaced apart from one another in a circumference direction on one of its ends; and a screw member which is combined with a screw hole of the small diameter member of the holder member wherein the diameter-enlarging member is placed between the screw member and the holder member, enlarges the diameter of the elastic pieces of the diameter-enlarging member by pressing the diameter-enlarging member toward the large diameter part and moving forward when rotating in an engagement direction of the screw hole, and is maintained to contact the inner circumference of the tubular anodic member.

6. The apparatus of claim 1, wherein the anodic assembly further includes an insulating thin plate interposed between the surface of the object to be corrosion-protected and the insulating filter member and in a partial region where a perforated contact hole is formed.

7. The apparatus of claim 1, wherein the anodic assembly further comprises:

a support which is combined with the exposed surface so that the support is stood and arranged on the exposed surface of the object to be corrosion-protected and which supports the anodic member to be spaced apart from the exposed surface; and an insulating connection member wherein a through hole through which the electrode lead line is passed is formed in a central region of the insulating connection member in a lengthwise direction, and both ends of which are detachably combined with ends of the support and the anodic member.

8. The apparatus of claim 1, wherein the insulating filter member is a non-woven fabric lining, and the absorption conductive member is coke breeze.

9. A method for cathodic protection in an environment where thin film corrosive fluids are formed, which protects from corrosion an object exposed to the thin film corrosive fluids, by artificially adjusting a potential of the object, the method comprising:

providing an anodic assembly having an anodic member that is electrically connected to a DC power supply;

installing the anodic assembly on an exposed surface of the object to be corrosion-protected so that the anodic member is spaced apart from the exposed surface of the object to be corrosion-protected, and electrically connecting a cathode of the DC power supply to the object to be corrosion-protected;

forming a resin coating layer on the exposed surface by coating acid resisting and thermostable resin coating material; and flowing a current between the anodic member and the cathode.

10. The method of claim 9, wherein a painting layer is further formed between the exposed surface of the object to be corrosion-objected and the resin coating layer.

11. The method of claim 9, wherein the anodic assembly further includes an insulating filter member through which the corrosive fluids pass and which accommodates the anodic member in an accommodation space formed inside the insulating filter member, an electrode lead line which electrically connects the DC power supply to the anodic member, and an absorption conductive member which is accommodated in the insulating filter member to surround the circumference of the anodic member and absorbs the corrosive fluids flowing along an exposed surface of the object to be corrosion-protected, and further comprising absorbing the corrosive fluids flowing around the exposed surface of the object to be corrosion-protected into the absorption conductive member.

12. The method of claim 9, wherein the object to be corrosion-protected is a duct of desulfurization facilities, and the corrosive fluids are a sulfuric acid solution.

13. The method of claim 9, wherein the resin coating material used for the resin coating layer is fluoric elastoma.

* * * * *